US006433773B1

(12) United States Patent
Hasuda

(10) Patent No.: US 6,433,773 B1
(45) Date of Patent: Aug. 13, 2002

(54) TABLET INPUT DEVICE WITH SWITCH

(75) Inventor: Kenji Hasuda, Tokyo (JP)

(73) Assignee: SMK Corporation, Tokyo (JP)

( * ) Notice: Subject to any disclaimer, the term of this patent is extended or adjusted under 35 U.S.C. 154(b) by 51 days.

(21) Appl. No.: 09/657,837

(22) Filed: Sep. 7, 2000

(30) Foreign Application Priority Data

Sep. 7, 1999 (JP) ..... 11-253628

(51) Int. Cl.[7] ..... G09G 5/00

(52) U.S. Cl. ..... 345/156; 345/161; 345/167; 200/5 A

(58) Field of Search ..... 345/156, 163, 345/167, 169, 161, 160; 200/43.01, 5 A; 341/22, 23; 463/36, 37, 38, 39; D14/388, 402, 412, 417, 426; 379/52, 110.01, 441, 456

(56) References Cited

U.S. PATENT DOCUMENTS 2,966,559 A * 12/1960 Meyer ..... 345/156
3,849,611 A * 11/1974 Walker, Jr. ..... 200/5 A
4,851,626 A * 7/1989 Nagashima ..... 200/5 A
5,278,371 A * 1/1994 Watanabe et al. ..... 200/344
5,504,283 A * 4/1996 Kako et al. ..... 200/5 A
5,815,139 A * 9/1998 Yoshikawa et al. ..... 345/157
5,889,507 A * 3/1999 Engle et al. ..... 345/161
6,252,582 B1 * 6/2001 Rogers et al. ..... 345/156

FOREIGN PATENT DOCUMENTS

JP 10-348716 12/1998
JP 2000-172429 6/2000

* cited by examiner

*Primary Examiner*—Dennis-Doon Chow
*Assistant Examiner*—Alecia D. Nelson
(74) *Attorney, Agent, or Firm*—Foley & Lardner

(57) ABSTRACT

The invention provides a tablet input device with a switch in which no pressing force for operating a pushbutton switch is changed in accordance with a pressing position of an operating button. When an operating portion 61 of an operating button 6 stored to a tablet case 7 is shifted from its center and is pressed and operated, an upper sheet 51 and a lower sheet 52 of a tablet sheet 5 located below the operating button 6 come in contact with each other in a shifting position by a spherical crown-shaped portion 62 of the operating button 6 so that output data showing a shift operating amount from the contact position are outputted. When the operating portion 61 is shift-operated and pressed against elastic force of the elastic leg body 8, the tablet case 7 is horizontally pushed down and a bottom portion 71 of the tablet case 7 pushes down an actuator 32 of a pushbutton switch 31 so that the pushbutton switch 31 is operated.

1 Claim, 9 Drawing Sheets

TABLET INPUT DEVICE WITH SWITCH

BACKGROUND OF THE INVENTION

1. Field of the Invention

This invention relates to a tablet input device with a switch. More particularly, this invention relates to a tablet input device with a switch capable of controlling the movements of a cursor, a pointer, etc. in accordance with an operating direction and additionally integrated with a deterministic switch for determining positions of the cursor, the pointer, etc.

2. Description of the Background Art

A cursor or a pointer showing a designating position must be able to be smoothly moved on a display such as a personal computer, etc., and a switch must be able to be pushed and inputted in a predetermined moved position. It is desirable to move the cursor or the pointer and input the switch by a series of operations. Therefore, the applicant already proposed "a tablet input device with a switch" (Japanese Patent Application No. 348716 in 1998 as an input device of this kind. The tablet input device with a switch (Japanese Patent Application No. 348716 in 1998) will next be explained on the basis of FIGS. 10 and 11.

In this tablet input device with a switch, as shown in FIGS. 10 and 11 as assembly views, tablet sheets 106*a*, 106*b* as a pair are spaced from each other at a slight distance and are arranged in parallel with each other. An operating button 102 is arranged on the tablet sheets 106*a*, 106*b*. A bottom face 102*b* of the operating button 102 is formed in a spherical crown shape and an operating portion 102*a* is formed on an upper face of the operating button 102. The operating button 102 and the tablet sheets 106 are stored to a tablet case 105 such that the operating portion 102*a* faces outward and the operating button 102 is freely rolled on the tablet sheets 106. The tablet case 105 storing the operating button 102 and the tablet sheets 106 in this way is supported and located between an attaching plate 108 for cantilevering a leaf spring piece 107 and the inner face of an outer case 111 having an opening 111*a* bored such that the operating portion 102*a* formed in the operating button 102 faces further outward. A pushbutton switch 113 is arranged inside the leaf spring piece 107 or the tablet case 105 and an actuator 113*a* is arranged in the pushbutton switch 113.

In the tablet input device 101 with the switch formed in this way, the bottom face 102*b* formed in a spherical crown shape is rolled on the tablet sheets 106 by operating the operating portion 102*a* of the operating button 102 and is pressed in a position shifted from a center of the operating button 102. The tablet sheets 106*a* and 106*b* then come in contact with each other in a rolling position. Output data showing a shift operating amount from the center of the operating button 102 are outputted from the contact position of the tablet sheets 106*a* and 106*b*.

Further, the operating button 102 is pressed against elastic force of the leaf spring piece 107 with pressing force equal to or greater than a predetermined value in a contact state of the tablet sheets 106*a* and 106*b*. Thus, the actuator 113*a* is pushed down by the leaf spring piece 107 or the tablet case 105 and the pushbutton switch 113 is operated.

Thus, in the conventional example, the shift operating, amount in the rolling position is outputted by rolling the operating button 102 and the operating button 102 is pressed by further strengthening the pressing force in this position so that the actuator 113*a* is pushed down and the pushbutton switch 113 can be operated. However, in this tablet input device with the switch, the pressing force for pressing the actuator 113*a* becomes pressing force equal to or greater than a predetermined value and resisting elasticity of the leaf spring piece 107, but the actuator 113*a* is pressed in a shifting position in which the operating button 102 is rolled. Accordingly, a distance from a cantilever position of the leaf spring piece 107 to a pressing force point on the leaf spring piece 107 is changed in accordance with the shifting position. Therefore, a problem exists in that the pressing force for pressing the actuator 113*a* is different in accordance with the shifting position. Namely, when the actuator 113*a* is pressed on a side close to the attaching plate 108 in the cantilever position of the leaf spring piece 107, stronger pressing force is required in comparison with a case in which the actuator 113*a* is pressed on a side far from the attaching plate 108 (i.e., a side close to the actuator 113*a*). Thus, a problem exists in that the pressing force is different in accordance with the shifting position for pressing the actuator 113*a*. Further, a supporting portion 108*a* for cantilevering the leaf spring piece 107 is indispensable. It is necessary to fix the supporting portion 108*a* to the outer case 111 in a position. shifted from at least the tablet case 105. Therefore, for example, when the supporting portion 108*a* is fixed to a portion in which there is no sufficient mounting space as in a remote controller, a problem exists in that the arrangement of switches, etc. arranged on a surface of the outer case 111 is limited.

SUMMARY OF THE INVENTION

In consideration of the above problems, an object of this invention is to provide a tablet input device with a switch in which no pressing force for pressing an actuator depends on a shifting position of an operating button and an attaching space to an outer case is reduced.

Therefore, this invention provides a tablet input device with a switch comprising:

- a tablet sheet constructed by upper and lower sheets arranged such that surfaces of the upper and lower sheets are oppositely spaced from each other;
- an operating button arranged on the tablet sheet such that a bottom face coming in contact with the tablet sheet is formed and an operating portion is formed on a surface of the operating button;
- a tablet case in which an outer frame is formed around a bottom portion formed in a plate shape and the operating button and the tablet sheet are opposed to each other so as to freely roll the bottom face of the operating button on the tablet sheet, and the operating portion of the operating button faces. outward and is stored into the outer frame;
- an outer case in which an opening for making the operating portion of the operating button face outward is bored;
- a substrate set such that the tablet case is nipped and oppositely arranged between the substrate and the outer case;
- a pushbutton switch arranged on a substrate surface opposed to the opening bored in the outer case and having an actuator arranged on an opening side; and
- an elastic leg body in which a basic end portion is fixed to an outside face of the outer frame arranged in the tablet case and a first leg body slantingly extends from the basic end portion to a substrate side, and a second leg body crosses the first leg body in an X-shape and has a basic end portion slidably engaged along an outside face of the outer frame of the tablet case and is rotatable with respect to the first leg body with a crossing portion as a center, and the first and second leg bodies are respectively arranged on opposite sides of the outer frame;

the tablet input device being constructed such that:

the operating portion of the operating button is shifted from its center and is pressed and operated, and the upper and lower sheets come in contact with the bottom face of the operating button in a shifting position so that the tablet sheet outputs output data showing a shift operating amount from the contact position; and the operating portion of the operating button is pressed by pressing force resisting elastic force of the elastic leg body, and the bottom portion of the tablet case pushes down the actuator of the pushbutton switch so that the pushbutton switch is operated.

In an operation of this invention, when the operating portion of the operating button is operated in a position shifted from the center, the bottom face of the operating button is rolled and the upper and lower sheets of the tablet sheet come in contact with each other in the shifting position. The tablet sheet outputs output data showing a shift operating amount from the shifting contact position.

When the operating portion of the operating button is pressed by pressing force stronger than the elastic force of the elastic leg portion, the X-shape of the crossing elastic leg body is deformed and the tablet case is moved in parallel and pushes down the actuator of the pushbutton switch arranged on the substrate so that the pushbutton switch is operated.

DESCRIPTION OF THE PREFERRED EMBODIMENTS

Figure 1:
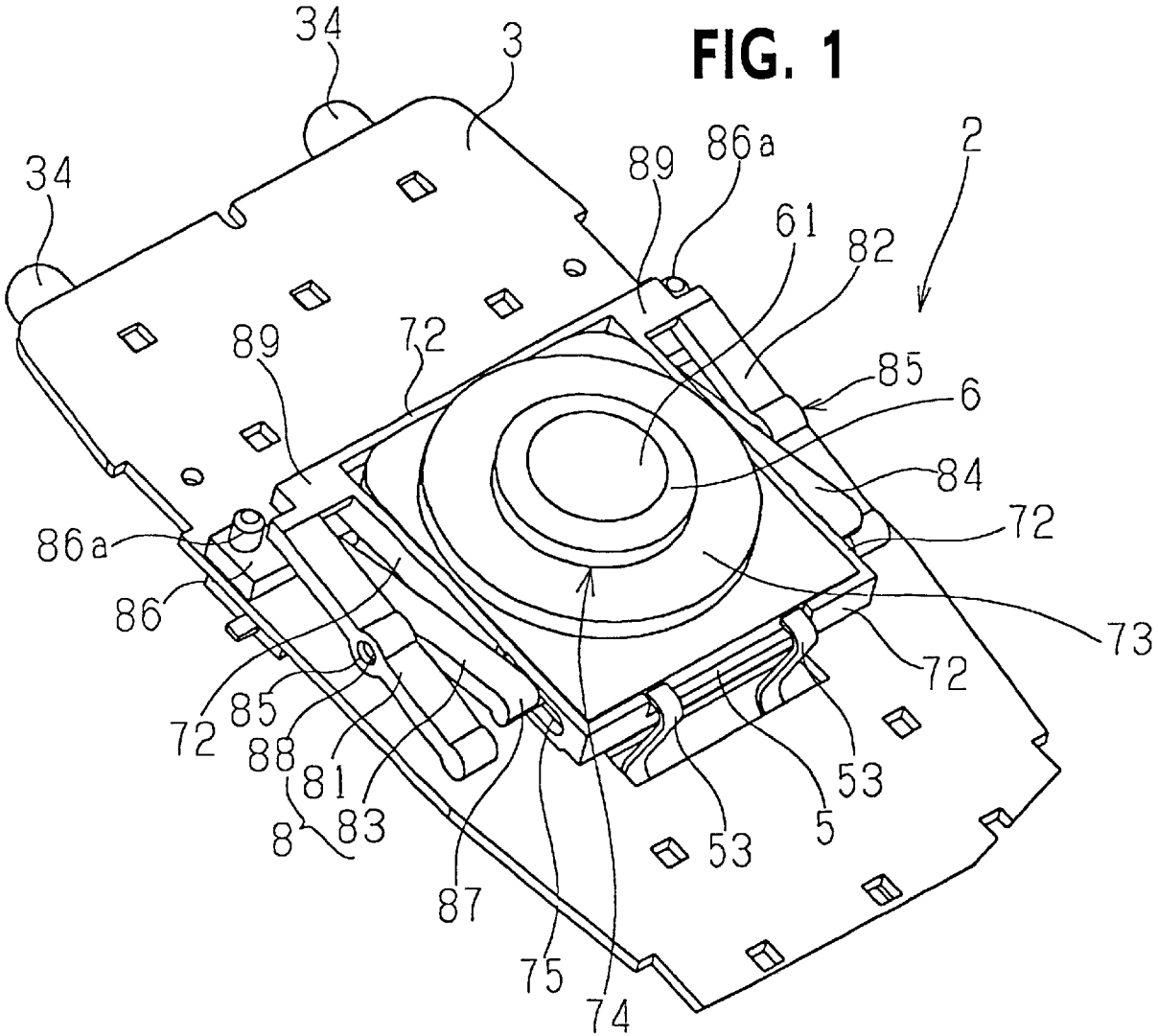
FIG. 1 is a perspective explanatory view of a tablet input device with a switch in an embodiment mode.
Figure 2:
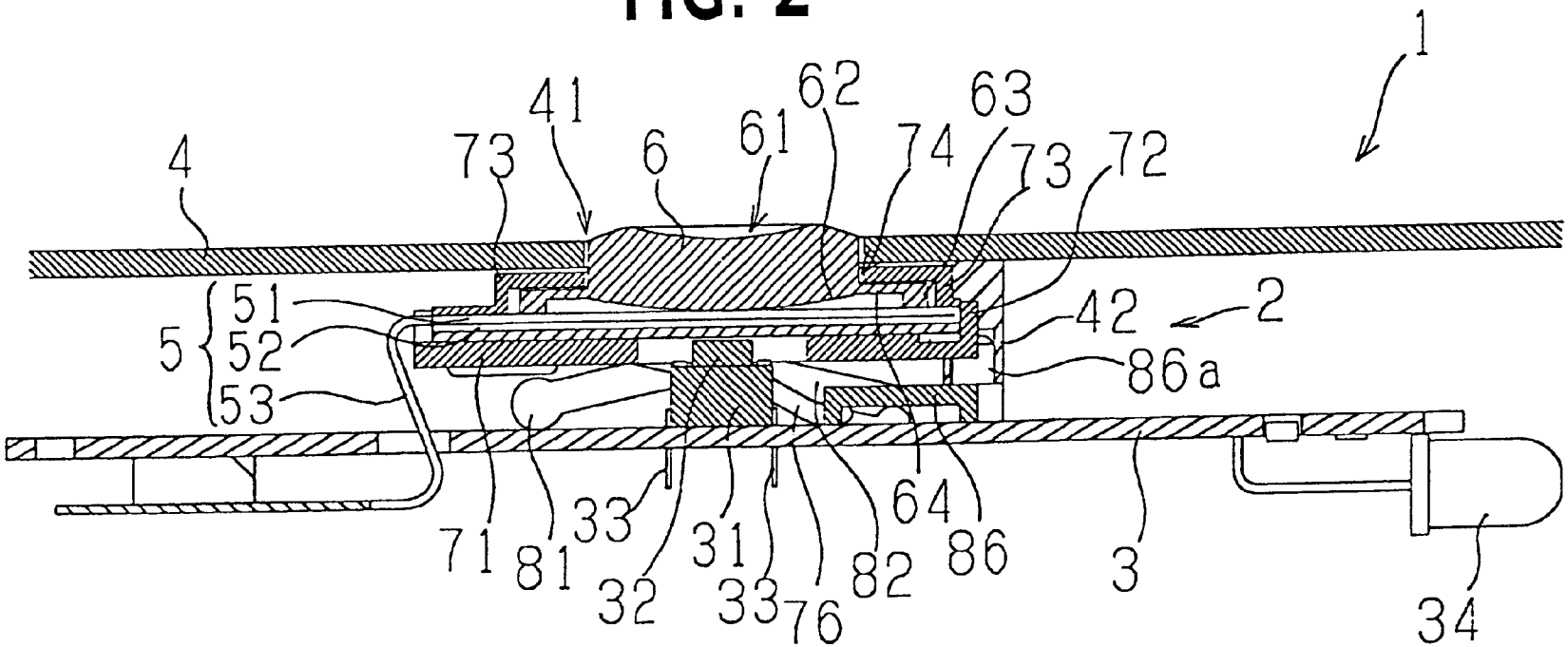
FIG. 2 is a central sectional explanatory view of the tablet input device of FIG. 1.
Figure 3:
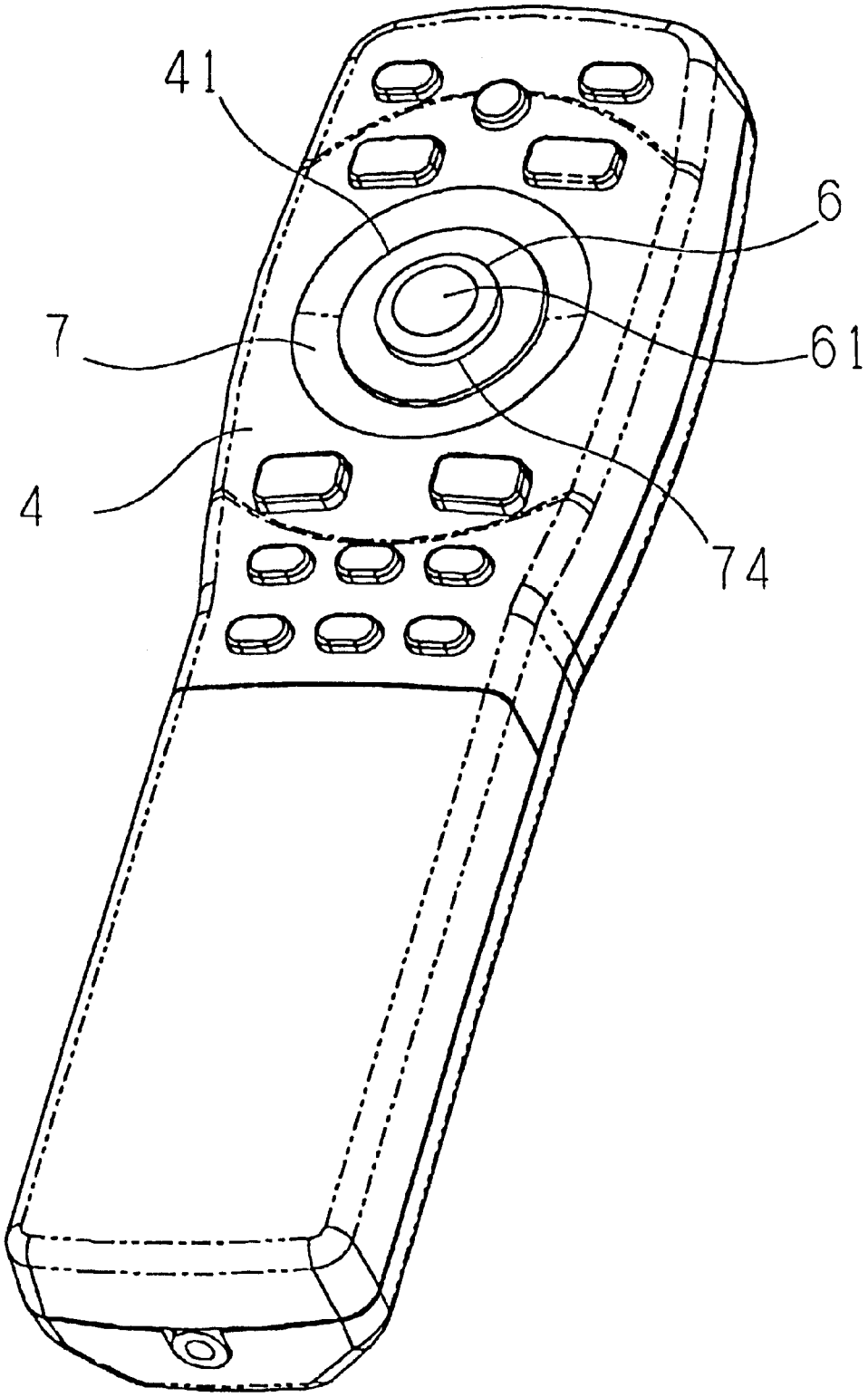
FIG. 3 is a view showing an external appearance of the tablet input device in the embodiment mode.
Figure 4:
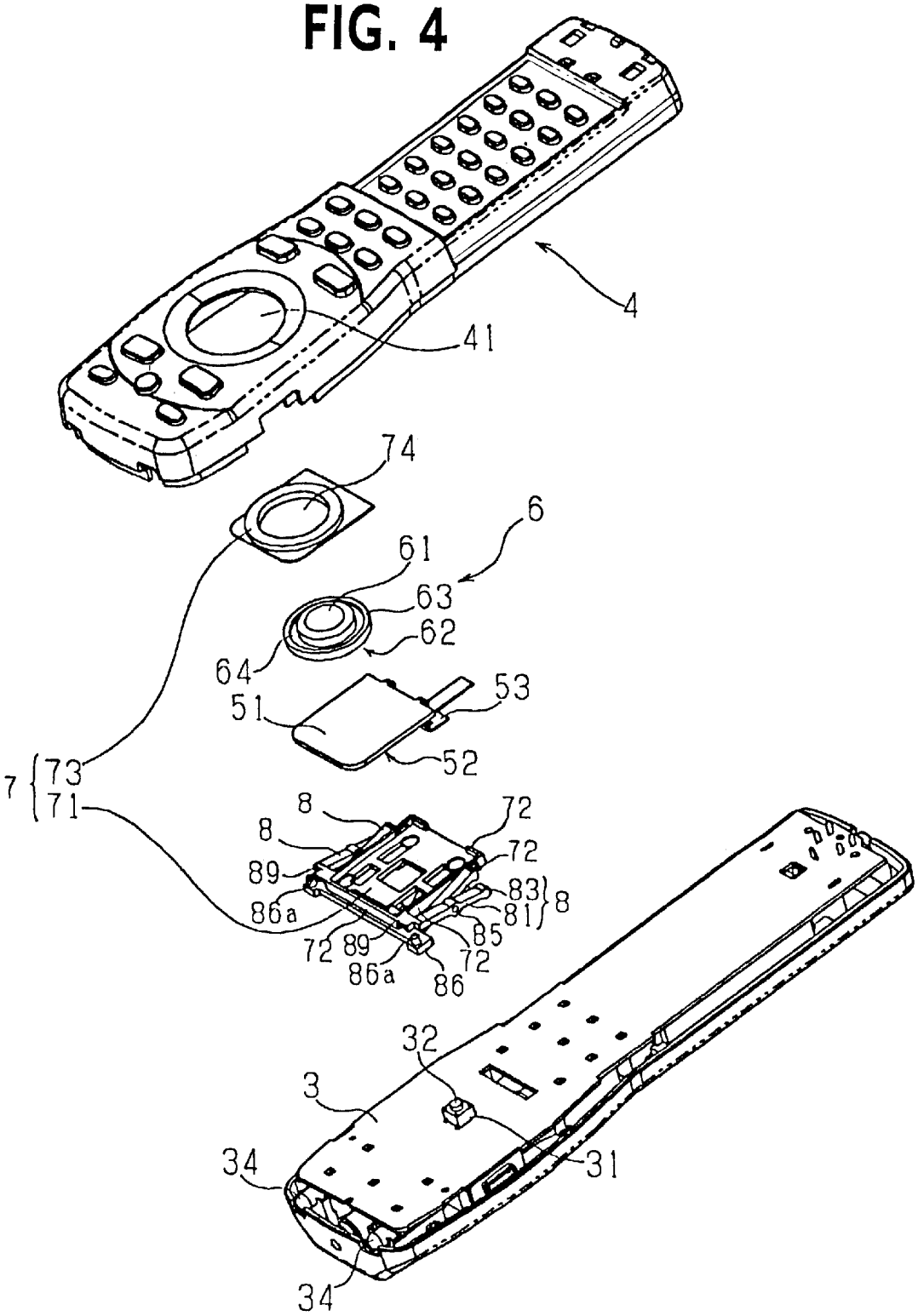
FIG. 4 is an exploded perspective view of the tablet input device in the embodiment mode.
Figure 5A:
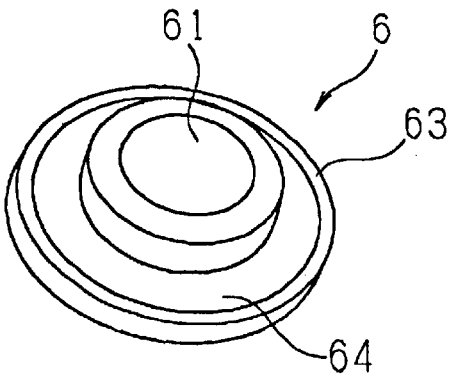
FIG. 5 is an explanatory view of an operating button as parts in the embodiment mode.
Figure 5B:
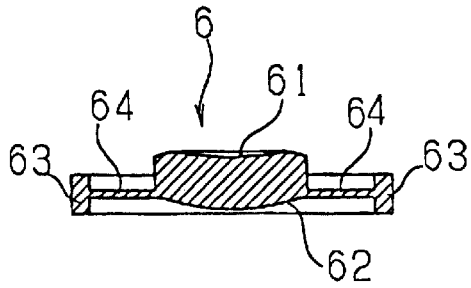
Figure 6:
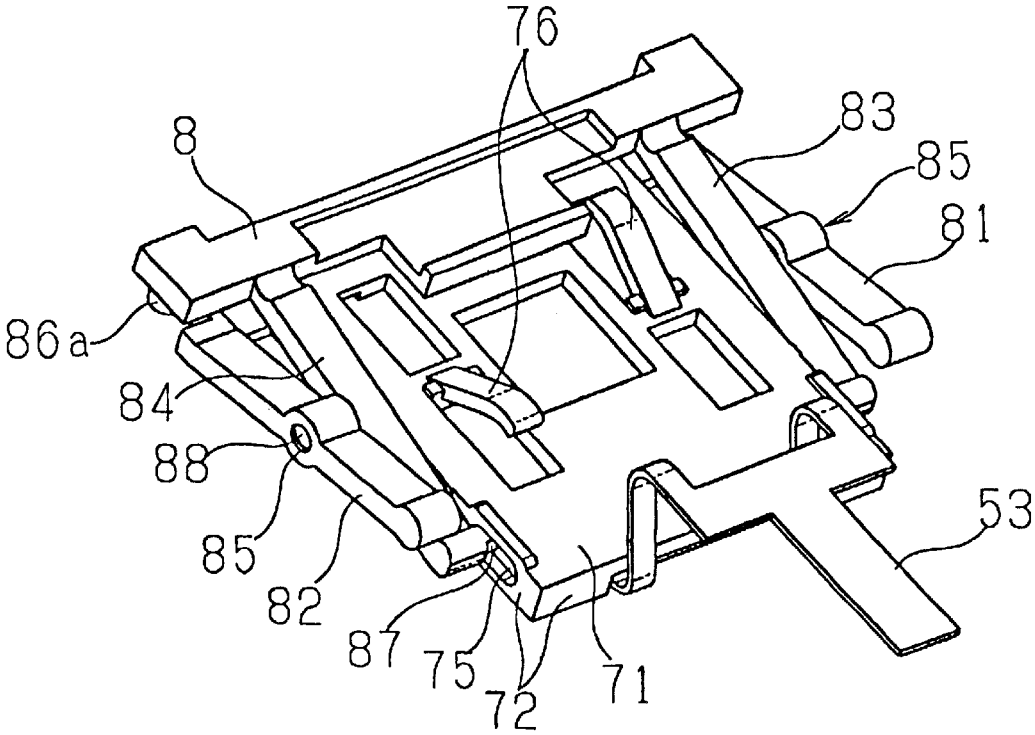
FIG. 6 is a sectional explanatory view of a tablet case.
Figure 7:
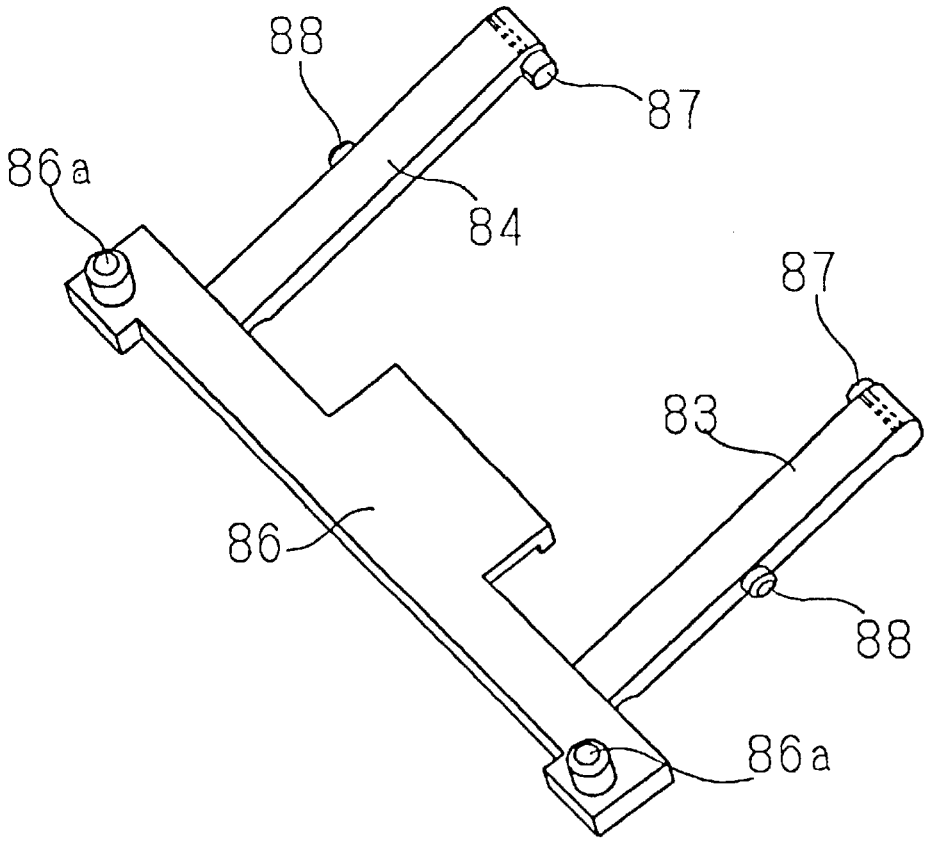
FIG. 7 is an explanatory view showing one portion of an elastic leg body.
Figure 8:
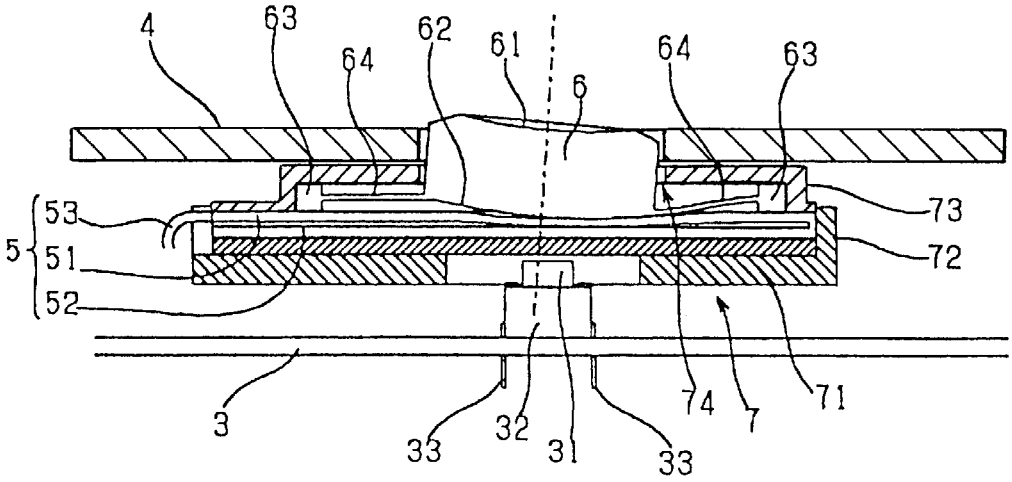
FIG. 8 is a sectional explanatory view showing an operating state of the tablet input device in the embodiment mode.
Figure 9:
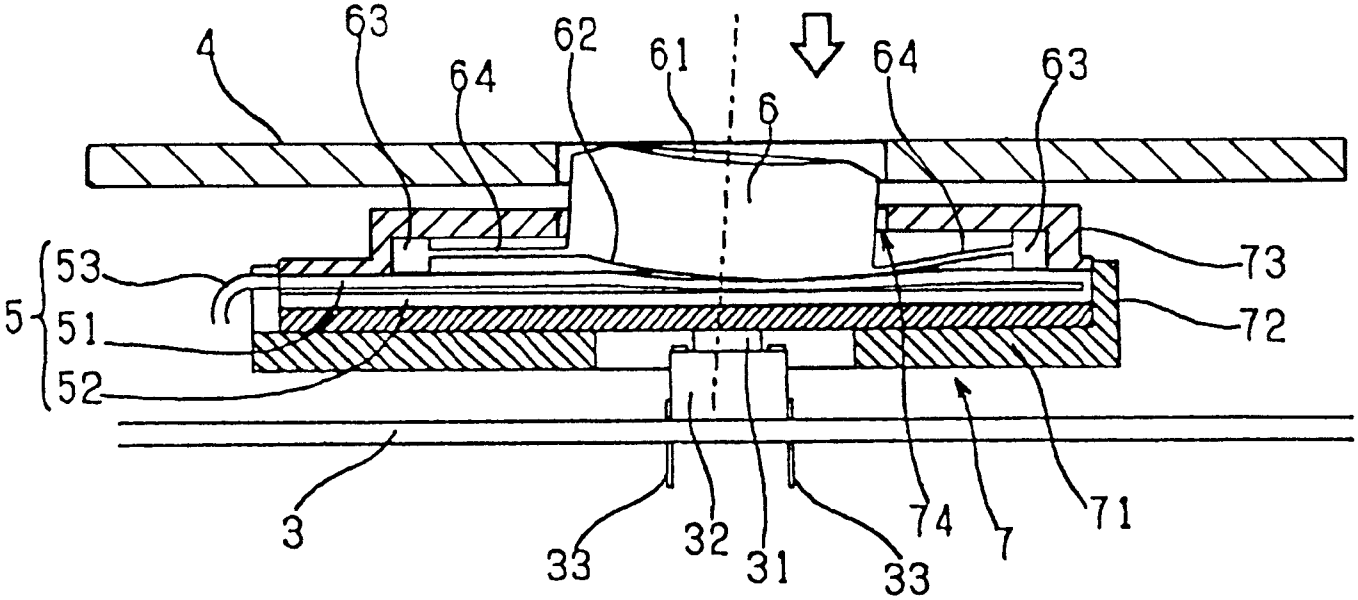
FIG. 9 is a sectional explanatory view showing the operating state of the tablet input device in the embodiment mode.
Figure 10:
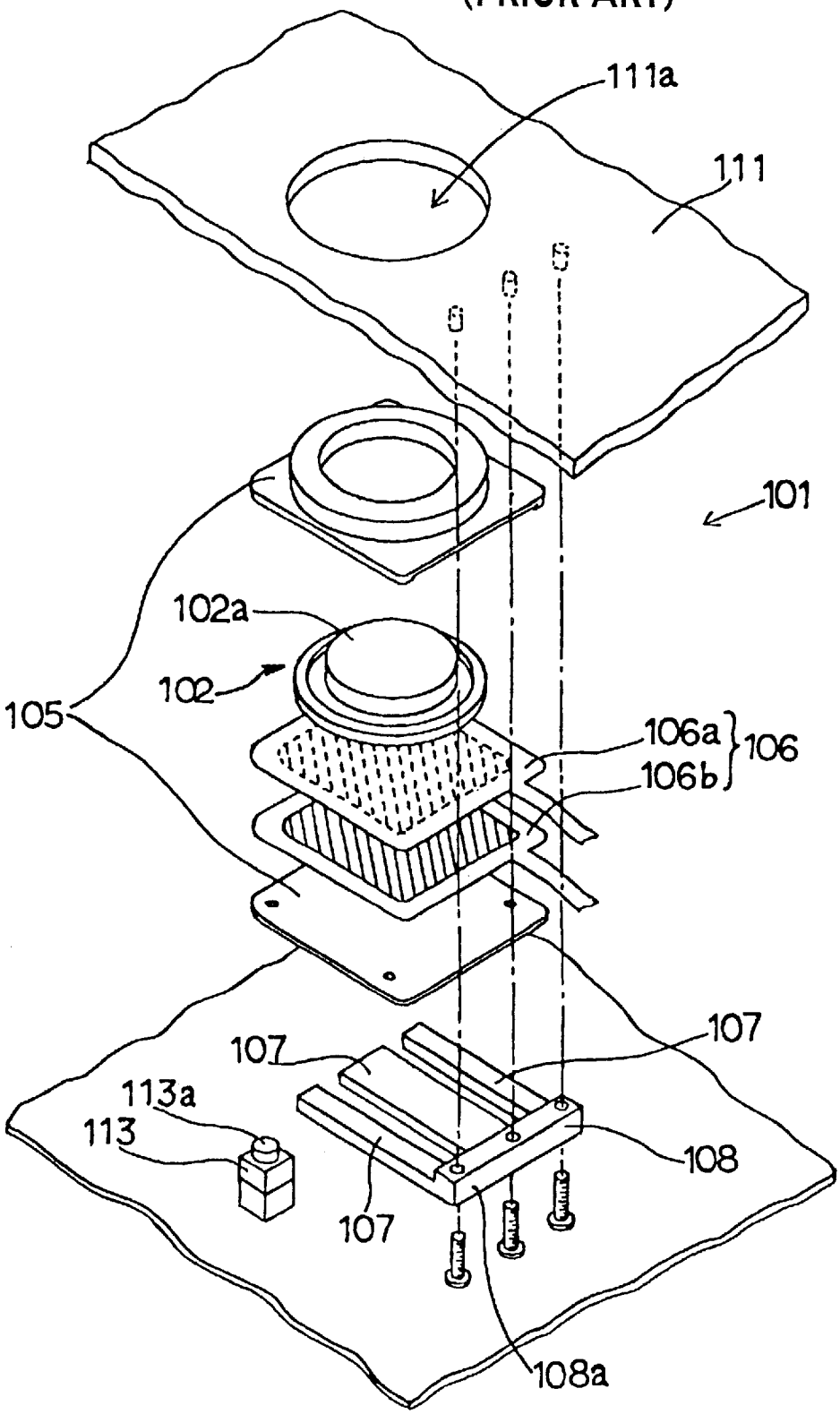
FIG. 10 (PRIOR ART)
FIG. 10 is an exploded explanatory view of a conventional tablet input device with a switch.
Figure 11:
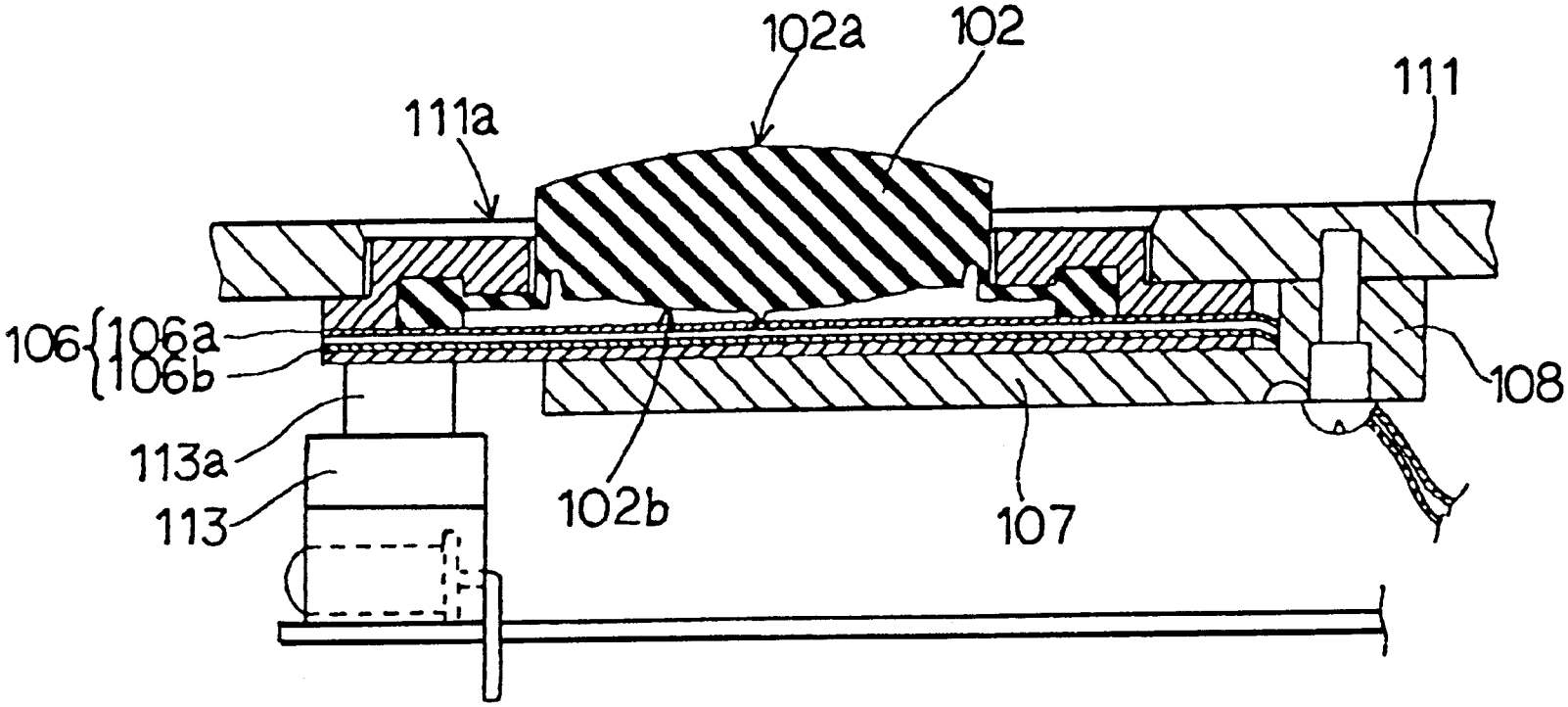
FIG. 11 (PRIOR ART)
FIG. 11 is a longitudinal sectional explanatory view showing an operating state of the conventional tablet input device.

Embodiment modes of this invention will next be explained on the basis of the drawings. FIG. 1 is a perspective explanatory view of a tablet input device with a switch having a signal transmitting portion so as to be built in a remote controller. FIG. 2 is an explanatory view showing a. central section of the tablet input device of FIG. 1. FIG. 3 is a view showing an external appearance of the tablet input device in the embodiment mode. FIG. 4 is an exploded perspective view for explaining this embodiment mode. FIG. 5 is explanatory views of an operating button in which FIGS. 5(*a*) and 5(*b*) are respectively perspective and sectional views of the operating button. FIG. 6 is a sectional explanatory view of a tablet case. FIG. 7 is an explanatory view of a second leg body. FIG. 8 is a sectional explanatory view showing an operating state of the operating button. FIG. 9 is a sectional explanatory view showing a pressing state of the operating button.

Reference number 1 designates a tablet input device with a switch. As shown in FIGS. 1 and 3 the tablet input device 1 with a switch is constructed by a pointer switch portion 2 capable of performing an inputting operation, A substrate 3 for mounting the pointer switch portion 2, and an outer case 4 opposed to the substrate 3 such that the pointer switch portion 2 is nipped between the substrate 3 and the outer case 4.

The pointer switch portion 2 is connected to an electronic circuit mounted to the substrate 3 by a flat cable 53 so as to input and output signals. In this embodiment mode, as shown in FIG. 3, the tablet input device 1 with a switch is built in a remote controller so that the outer case 4 is constructed by a case forming an outer cover of the remote controller.

In the pointer switch portion 2, a tablet sheet 5 capable of outputting a signal by pressing this tablet sheet 5 and an operating button 6 for pressing the tablet sheet 5 are stored to a tablet case 7. Further, the pointer switching portion 2 is also constructed by an elastic leg body 8 fixed to a side portion of the tablet case 7.

In the tablet sheet 5, an upper sheet 51 and a lower sheet 52 formed in the shape of a thin film as upper and lower rectangular sheets are oppositely spaced from each other at a slight distance as shown in FIG. 4. The distance between the upper and lower sheets 51 and 52 is held by arranging an unillustrated insulating spacer between opposed end portions of the upper and lower sheets 51, 52. Further, a flat cable 53 for outputting a signal and electrically connected to the substrate 3 extends from one end portions of the upper and lower sheets 51, 52. The flat cable 53 is electrically connected to the substrate 3 so as to output a signal. The tablet sheet 5 can output an output signal showing a shifting amount from the flat cable 53 in accordance with a contact position of the upper sheet 51 and the lower sheet 52.

As shown in FIG. 5, the operating button 6 is formed in a convex shape seen from its side. A central projecting portion of the convex shape is formed in a cylindrical shape as an operating portion 61. A spherical crown-shaped portion 62 is formed on a bottom face of the operating portion 61 and a center of this spherical crown-shaped portion 62 is formed as a convex curved surface. Further, a flange portion 63 of a ring shape slightly projecting from the spherical crown-shaped portion 62 to a bottom face side is formed at an outer edge of a flange portion of the convex shape. The flange portion 63 is connected to a side face of the spherical crown-shaped portion 62 by an elastic portion 64 thinly formed. The operating button 6 is arranged on the upper sheet 51 of the tablet sheet 5 such that the spherical crown-shaped portion 62 is located on a side of the upper sheet 51. In such an arranging state, the operating portion 61 of the operating button 6 is shift-operated from the center of the operating portion 61 and the spherical crown-shaped portion 62 presses the upper sheet 51 such that the upper sheet 51 comes in contact with the lower sheet 52. Thus, the upper sheet 51 and the lower sheet 52 can come in contact with each other in a shifting position of the spherical crown-shaped portion 62. Further, since the spherical crown-shaped portion 62 and the flange portion 63 are connected to each other by the elastic portion 64 in the operating button 6, the spherical crown-shaped portion 62 is easily freely rolled on the tablet sheet 5 when the operating portion 61 is shift-operated. Further, the operating portion 61 is formed such that the center of an upper face of this operating portion 61 is slightly recessed in the shape of a concave curved surface, thereby improving operability of the operating portion 61. (In this embodiment mode, the spherical crown-shaped portion 62 is formed from only the convex curved surface, but a projecting portion slightly projecting from the other curved surfaces may be formed at a center of the spherical crown-shaped portion 62 in accordance with necessity. When the projecting portion is formed, the upper sheet 51 and the lower sheet 52 of the tablet sheet 5 can already come in contact with each other at a center of the tablet sheet 5 even when no operating portion 61 is operated. Accordingly, in this case, the operating portion 61 is next operated and a signal can bet outputted in a state in which an operating amount till the contact of the upper sheet 51 and the lower sheet 52 is set to a shift from the center of the tablet sheet 5.)

As shown in FIGS. 4 and 6, a bottom portion 71 is formed in the tablet case 7. The bottom portion 71 can arrange the tablet sheet 5 thereon and is formed in the shape of a rectangular plate. An outer frame 72 is vertically arranged upward from four end sides around the bottom portion 71. Further, the tablet case 7 covers an upper face of the bottom portion 71 with a case cover 73 from above the bottom portion 71. The bottom portion 71 and the outer frame 72 are integrally molded by synthetic resin, etc., and the bottom portion 71 is strongly formed by fixing a metallic plate, etc. to a surface of this bottom portion 71. The case cover 73 is formed by a plate-shaped body of the same shape as the interior of the outer frame 72. A button hole 74 is bored at a center of the case cover 73 and the convex operating portion 61 formed in the operating button 6 can be inserted into this button hole 74, and the operating portion 61 faces outward.

In the tablet case 7, the tablet sheet 5 is arranged such that the lower sheet 52 is located on the bottom portion 71. Further, the operating button 6 is arranged such that the upper sheet 51 of the tablet sheet 5 and the spherical crown-shaped portion 62 of the operating button 6 are opposed to each other. In the tablet case 7 arranging the tablet sheet 5 and the operating button 6 thereon, the case cover 73 is covered from above by inserting the operating portion 61 of the operating button 6 into the button hole 74 of the case cover 73. The tablet sheet 5 and the operating button 6 can be nipped and stored into the tablet case 7 by forming the tablet case 7 in this way. In this embodiment mode, the bottom portion 71 and the case cover 73 are fixed to each other by welding unillustrated bosses rising in opposite positions of unillustrated boss holes on a bottom face of the case cover 73 in a state in which these bosses are respectively inserted into unillustrated boss holes bored at four corners of the bottom portion 71. Elongated holes 75 are respectively bored in the same position along the pair of opposed outer frames 72 in their outside end portions. Further, as shown in FIG. 6, thin elastic assistant leg portions 76 are formed on a face of the bottom portion 71 opposed to the substrate 3 and slantingly project on a side of the substrate 3.

Elastic leg bodies 8 are respectively constructed by first leg bodies 81, 82 and second leg bodies 83, 84 each formed in a bar shape. One end of each of the first leg bodies 81, 82 has a basic end portion that is fixed to an end portion of the outer frame 72 having the elongated hole 75 in which no elongated hole 75 is bored. The other end of each of the first leg bodies 81, 82 is slantingly arranged on a side of the substrate 3 along this outer frame 72. Similar to the one first leg body 81, one end of the other first leg body 82 is fixed to an outer frame 72 opposed to the outer frame 72 fixing the one first leg body 81 thereto, and the other end of the other first leg body 82 is slantingly arranged on a side of the substrate 3 Accordingly, the first leg bodies 81, 82 are slantingly arranged in parallel with each other from the outer frames 72 to a side of the substrate 3. Further, attaching holes 85 are respectively bored toward sides of the outer frames 72 in intermediate portions of the first leg bodies 81, 82.

The second leg bodies 83, 84 are respectively attached to the first leg bodies 81, 82 formed in this way. As shown in FIG. 7, the second leg bodies 83, 84 are connected to each other in a U-shape at one ends thereof by a connecting portion 86. A sliding shaft 87 able to be inserted into the elongated hole 75 of the tablet case 7 is projected in an opposite direction in each of basic end portions as the other ends of the second leg bodies 83, 84. A boss 86*a* for positioning the connecting portion 86 in the outer case 4 is bored on a side of the outer case 4 in each of both end portions of the connecting portion 86. Further, a rotating shaft 88 is projected in each of intermediate portions of the second leg bodies 83, 84 such that the rotating shaft 88 can be inserted into the attaching hole 85 bored in each of the first leg bodies 81, 82. In the second leg bodies 83, 84 formed in this way, the sliding shafts 87 are respectively inserted into the elongated holes 75 of the outer frames 72 and the rotating shafts 88 are respectively inserted into the attaching holes 85 of the first leg bodies 81, 82 so that the connecting portion 86 is located on a side of the substrate 3. The fixing ends of the first leg bodies 81, 82 are fixedly connected to the outer frames 72 by elastic portions 89 thinly formed respectively. When force equal to or greater thank a predetermined force is applied to each of the elastic portions 89, the elastic portions 89 are respectively twisted and allow rotations of the first leg bodies 81, 82. In contrast to this, when this force is not applied to each of the elastic portions 89, the elastic portions 89 are again returned to their original positions.

In this embodiment mode, the first leg bodies 81, 82, the bottom portion 71 of the tablet case 7 as an arranging portion of the tablet sheet 5, the outer frames 72 and the assistant leg portions 76 are integrally molded by ABS resin and can be manufactured as one part. Accordingly, there are effects in that manufacturing cost can be reduced and an assembly process can be simplified, etc. When the operating portion 61 is pressed, the tablet case 7 can be smoothly moved downward by molding the second leg bodies 83, 84 and the connecting portion 86, and the first leg bodies 81, 82, the bottom portion 71 of the tablet case 7 as an arranging portion of the tablet sheet 5, the outer frames 72 and the assistant leg portions 76, or one of these two combinations by polyacetal resin having good sliding characteristics.

In the pointer switch portion 2 formed in this way, tips of the assistant leg portions 76 of the tablet case 7, the first leg bodies 81, 82 and the second leg bodies 83, 84 on a side of the substrate 3 are respectively located on a surface of the substrate 3 in a state in which the pointer switch portion 2 is nipped by the substrate 3 and the outer case 4.

As shown in FIG. 4, the substrate 3 in this embodiment. mode is formed in a shape in which the substrate 3 can be mounted into the outer case 4. A pushbutton switch 31 is mounted to the surface of the substrate 3 opposed to a central position of the bottom portion 71 of the tablet case 7. The pushbutton switch 31 is mounted to the substrate 3 by a terminal 33. An actuator 32 is arranged at a tip of the terminal 33 and the terminal 33 is projected from its other end to a side of the substrate 3. A circuit is closed within the pushbutton switch 31 by pressing the actuator 32 so that a turning-on state is set between connecting terminals of the substrate 3. Further, an infrared light emitting element 34 is arranged at a tip of the substrate 3 and transmits a signal processed by an electronic circuit element and an electronic circuit mounted to the substrate 3 to an unillustrated operated device.

An opening 41 is bored in the outer case 4 such that the substrate 3 is positioned and fixedly stored into the outer case 4 and the operating portion 61 is located outward together with the case cover 73 in a state in which the pointer switch portion 2 is nipped and located between the substrate 3 and the outer case 4. When the pointer switch portion 2 and the substrate 3 are stored into the outer case 4 in the state in which the pointer switch portion 2 is nipped and located between the outer case 4 and the substrate 3, the outer case 4 is formed such that the operating portion 61 is exposed to the exterior of the outer case 4 and can be operated. Further, an engaging portion 42 having a boss hole is formed in a positions opposed to a boss 86*a* of the pointer switch portion 2. The pointer switch portion 2 is positioned and arranged in, a predetermined position on the substrate 3 by engaging the boss 86*a* with the engaging portion 42 at an assembling time.

As mentioned above, the tablet input device 1 with the switch is operated in a state in which the pointer switch portion 2 is arranged in a nipping position of the substrate 3 and the outer case 4 and is assembled. Namely, the operating portion 61 exposed to the exterior from the opening 41 of the outer case 4 is shift-operated. Thus, as shown in FIG. 8, the upper sheet 51 and the lower sheet 52 come in contact with each other in a shifting position of the spherical crown-shaped portion 62 of the operating button 6. The tablet sheet 5 thus outputs a signal showing the shifting position in which the upper sheet 51 and the lower sheet 52 come in contact with each other. The outputted signal is processed by various kinds of electronic circuit elements and electronic circuits mounted to the substrate 3 and is transmitted from the infrared light emitting element 33 arranged at the tip of the substrate 3. A pointer or a cursor is moved by an operated shifting amount and is displayed on an unillustrated display device such as a display of an unillustrated operated device, etc. by such a transmitted output signal. At this time, the operating portion 61 is shift-operated by pressing force which does not push down the pushbutton switch 31 against elasticities of the assistant leg portions 76 of the tablet case 7, the first leg bodies 81, 82 and the second leg bodies 83, 84.

When the operating portion 61 is further pressed from a shift-operating state of the operating portion 61 by the pressing force resisting the elasticities of the assistant leg portions 76 of the tablet case 7, the first leg bodies 81, 82 and the second leg bodies 83, 84, the entire pointer switch portion 2 is pressed and moved downward as shown in FIG. 9. Namely, when the pressing force resisting the elasticities is applied, the first leg bodies 81, 82 are rotated with the elastic portion 89 as a center and the second leg bodies 83, 84 are rotated with the connecting portion 86 as a center. Thus, the sliding shafts 87 of the second leg bodies 83, 84 are respectively slid into the elongated holes 75 of the tablet case 7, and the assistant leg portions 76 of the tablet case 7 are also pressed against the substrate 3. Thus, the assistant leg portions 76 are elastically deformed and the tablet case 7 is pushed down on a side of the substrate 3 in parallel therewith. The actuator 32 of the pushbutton switch 31 mounted to the substrate 3 is then pushed down so that the pushbutton switch 31 is set to a closing state. Thus, the closing state is set between terminals 33 of the pushbutton switch 31 and a predetermined signal is transmitted from the infrared light emitting element 34 to the unillustrated operated device by various kinds of electronic circuit elements and electronic circuits mounted to the substrate 3. The. unillustrated operated device detects determination in the position of a pointer or a cursor by this transmitted signal.

Thus, the first leg bodies 81, 82 and the second leg. bodies 83, 84 are formed in the shape of a character X so as to be freely rotated in their intermediate portions. Accordingly, a moving distance until pushing-down of the actuator 32 of the pushbutton switch 31 and pressing force required to push down the actuator 32 become constant irrespective of a shifting and pushing-down position of the operating portion 61.

It is required to push down the tablet case 7 in parallel that an elastic strength generated by the elastic portion 89 for mainly fixing the first leg bodies 81, 82 and an elastic strength generated by the connecting portion 86 for connecting the second leg bodies 83, 84 are approximately equal to each other in design.

In this embodiment mode, predetermined pressing force for pushing down the actuator 32 of the pushbutton switch 31 is set by the elasticities of the assistant leg portions 76 of the tablet case 7, the first leg bodies 81, 82 and the second leg bodies 83, 84. However, the predetermined pressing force is also set by suitably adjusting a thickness of the elastic portion 89 for fixing the first leg bodies 81, 82 and a thickness of the connecting portion 86 for connecting the second leg bodies 83, 84 such that the pressing force is determined by only the elasticities of the first leg bodies 81, 82 and the second leg bodies 83, 84 without arranging the assistant leg portions 76 in the tablet case 7.

Accordingly, in accordance with this invention, the tablet case is supported by the substrate through the elastic leg bodies and is moved in parallel by the elastic leg bodies. when the tablet case is pushed down. Therefore, it is possible to constantly set a moving distance until an operation of the pushbutton switch and pressing force required to push down the operating portion irrespective of a pressing position of the operating portion. Accordingly, the tablet input device with the switch can be stably operated.

Further, since it is not necessary to fix the tablet case or the elastic leg bodies to the outer case by a screw, etc., a manufacturing process can be simplified and no large useless space of only cantilever required to form a cantilever shape is required.

What is claimed is:

1. A tablet input device with a switch comprising;

a tablet sheet constructed by upper and lower sheets arranged such that surfaces of the upper and lower sheets are oppositely spaced from each other;

an operating button arranged on the tablet sheet such that a bottom face coming in contact with the tablet sheet is formed and an operating portion is formed on a surface of thee operating button;

a tablet case in which an outer frame is formed around a bottom portion formed in a plate shape and the operating button and the tablet sheet are opposed to each other so as to freely roll the bottom face of the operating button on the tablet sheet, and the operating portion of the operating button faces outward and is stored into the outer frame;

an outer case in which an opening for making the operating portion of the operating button face outward is bored;

a substrate set such that the tablet case is nipped and oppositely arranged between the substrate and the outer case;

a pushbutton switch arranged on a substrate surface opposed to the opening bored in the outer case and having an actuator arranged on an opening side; and an elastic leg body in which a basic end portion is fixed to an outside face of the outer frame arranged in the tablet case and a first leg body slantingly extends from the basic end portion to a substrate side, and a second leg body crosses the first leg body in an X-shape and has a basic end portion slidably engaged along an outside face of the outer frame of the tablet case and is rotatable with respect to the first leg body with a crossing portion as a center, and the first and second leg bodies are respectively arranged on opposite sides of the outer frame;

the tablet input device being constructed such that:

the operating portion of the operating button is shifted from its center and is pressed and operated, and the upper and lower sheets come in contact with the bottom face of the operating button in a shifting position so that the tablet sheet outputs output data showing a shift operating amount from the contact position; and the operating portion of the operating button is pressed by pressing force resisting elastic force of the elastic leg body, and the bottom portion of the tablet case pushes down the actuator of the pushbutton switch so that the pushbutton switch is operated.

* * * * *